US005941205A

United States Patent [19]

Hiraoka et al.

[11] Patent Number: 5,941,205

[45] Date of Patent: Aug. 24, 1999

[54] INTAKE SYSTEM FOR A FOUR-CYCLE ENGINE POWERING AN OUTBOARD MOTOR

[75] Inventors: Noriyoshi Hiraoka; Masanori Takahashi; Atsushi Isogawa, all of Hamamatsu, Japan

[73] Assignee: Sanshin Kogyo Kabushiki Kaisha, Hamamatsu, Japan

[21] Appl. No.: 08/872,099

[22] Filed: Jun. 10, 1997

[30] Foreign Application Priority Data

Jun. 10, 1996 [JP] Japan ..... 8-146941
Jun. 14, 1996 [JP] Japan ..... 8-153778

[51] Int. Cl.[6] ..... F02B 75/22

[52] U.S. Cl. ..... 123/184.35; 123/54.4

[58] Field of Search ..... 123/184.35, 184.25, 123/54.6, 54.4, 54.7, 196 W, 195 P

[56] References Cited

U.S. PATENT DOCUMENTS 4,967,704 11/1990 Imaeda .
5,005,536 4/1991 Suzuki et al. ..... 123/184.35
5,016,579 5/1991 Suzuki et al. .
5,488,939 2/1996 Nakai et al. ..... 123/184.35
5,513,606 5/1996 Shibata .
5,673,655 10/1997 Mishima ..... 123/54.4
5,765,519 6/1998 Watanabe ..... 123/184.35

*Primary Examiner*—Marguerite McMahon
*Attorney, Agent, or Firm*—Knobbe, Martens, Olson & Bear LLP

[57] ABSTRACT

An intake system for an engine arranged to be positioned within a cowling of an outboard motor for powering a water propulsion device of the motor is disclosed. Preferably, the engine is of the "V"-type, having first and second banks defined by first and second cylinder heads connected to a cylinder block, and having a crankcase or second end positioned opposite the heads and facing the watercraft. Each bank contains at least one combustion chamber, and the banks define a valley extending therebetween along a length of the engine. An intake system is positioned at the second end of the engine and comprises a surge tank corresponding to each bank, an intake passage leading from each surge tank to the cylinders of its respective bank, and a throttle body having an air inlet and a branch passage leading to each surge tank. An engine auxiliary component is positioned above or below the throttle body of the intake system.

19 Claims, 16 Drawing Sheets

INTAKE SYSTEM FOR A FOUR-CYCLE ENGINE POWERING AN OUTBOARD MOTOR

FIELD OF THE INVENTION

The present invention relates to an engine of the type utilized to power an outboard motor. More particularly, the invention is an intake system for a four-cycle "V"-type engine positioned within a cowling of an outboard motor and used to power a water propulsion device of the motor.

BACKGROUND OF THE INVENTION

Outboard motors which are used to propel watercraft are positioned at the stem of the watercraft, generally attached to the transom. These motors comprise a cowling in which is positioned an internal combustion engine. The engine is arranged to drive a water propulsion device of the motor, such as a propeller.

The motor is connected to the watercraft in a manner which permits the motor to turn from side-to-side about a vertically extending axis for use in steering the watercraft In addition, the motor is tiltable about a generally horizontal axis for use in trimming the motor.

Because the motor is movably mounted to the craft, it is desirable for the motor to be as small as practical. It is, therefore, an object of the present invention to provide an engine which is compact in arrangement.

In addition, if the motor extends far beyond the rear of the watercraft, its center of gravity is far offset from the horizontal axis about which it tilts, making it very difficult to tilt the motor. Also, moving the center of gravity of the motor far from the stern of the watercraft affects the dynamics of the watercraft.

It is therefore another object of the present invention to provide an engine having a center of gravity positioned such that when the engine is used to power a motor connected to a watercraft, is close to the watercraft.

SUMMARY OF THE INVENTION

In accordance with the present invention, there is provided an engine which an intake system arranged to provide for a compact engine arrangement. Preferably, the engine is positioned within a cowling of an outboard motor and arranged to drive a water propulsion device thereof.

The engine having the intake system is of the four-cycle "V" type, having first bank and second banks each defined by a cylinder head connected to a cylinder block. Each bank contains at least one combustion chamber, and the banks define a valley therebetween.

The engine has a vertically extending crankshaft, and is positioned in the cowling such that a crankcase end of the engine faces the watercraft, while the valley of the engine faces away from the watercraft. Preferably, the intake system includes a surge tank corresponding to each bank and a passage leading from each surge tank to the cylinder(s) of its respective bank. Preferably, a throttle body is positioned between the surge tanks, the throttle body having an air inlet and a branch passage extending therefrom to each surge tank. An engine auxiliary feature is positioned generally above or below the throttle body.

In a first embodiment, the throttle body preferably extends upwardly to the air inlet and the engine auxiliary feature is positioned therebelow. In this embodiment, one or more fuel system elements, such as a vapor separator, fuel filter and low pressure pump, are positioned below the throttle body and between the surge tanks.

In a second embodiment, the throttle body is preferably positioned between the surge tanks and extends downwardly to the air inlet. The engine auxiliary feature, such as an alternator, is positioned above the throttle body.

Preferably, a thermal insulating mounting plate is utilized to support the throttle body. In that embodiment where the intake system is positioned near the crankcase of the engine, the plate is preferably connected thereto and extends therefrom to support the throttle body.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In accordance with the present invention, there is provided an outboard motor 20 powered by an engine 22 and having an intake system in accordance with the present invention. The engine 22 having the intake system is described for use with an outboard motor 20 since this particular application is one requiring the compact arrangement of the engine 22 described. It should be understood, however, that the engine 22 may be used in other applications.

Figure 1:
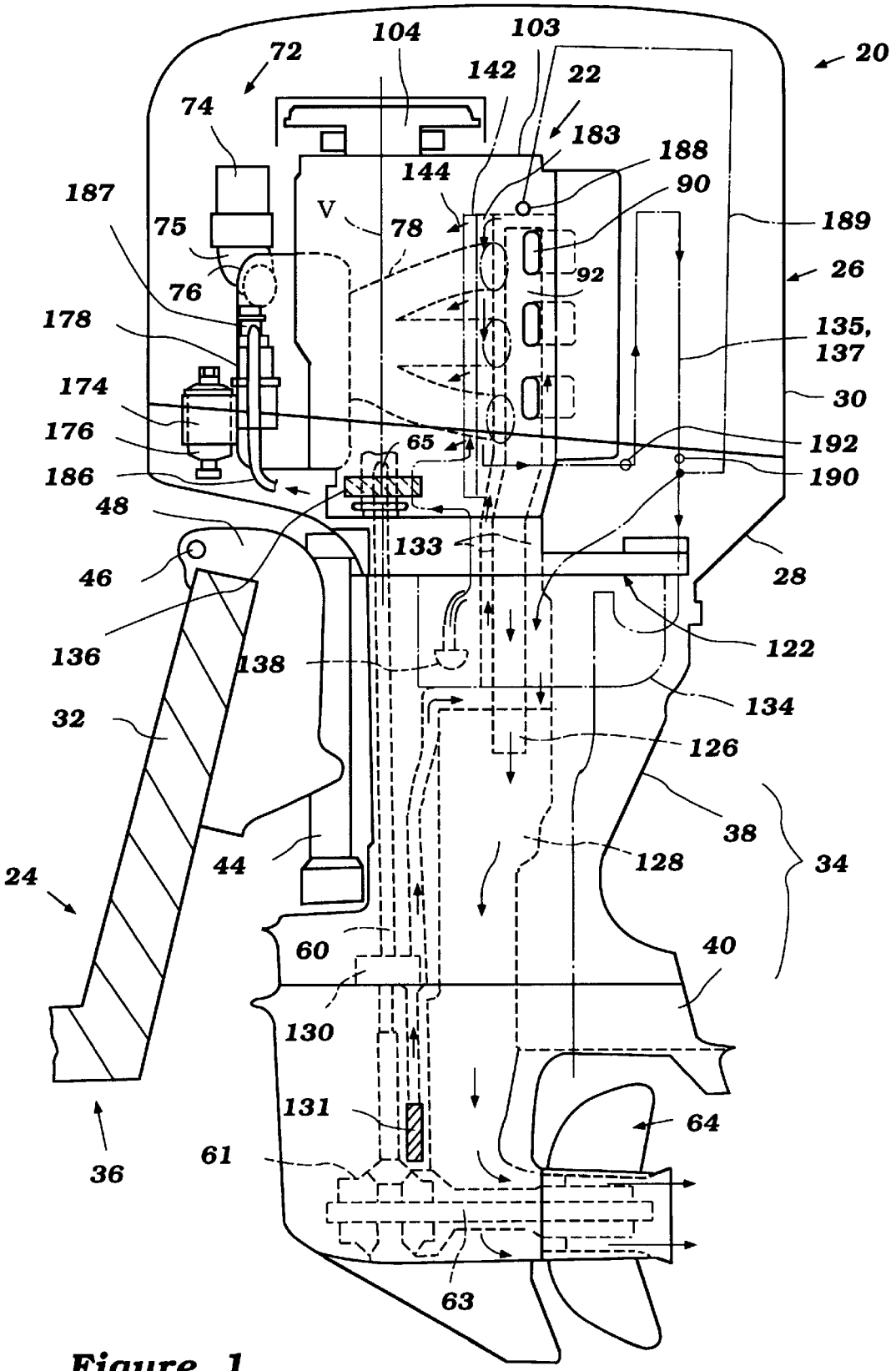
FIG. 1 is a side view of an outboard motor powered by an engine, illustrated in phantom, the motor having an intake system in accordance with a first embodiment of the present invention.

As illustrated in FIG. 1, the outboard motor 20 is of the type utilized to propel a watercraft 24. The outboard motor 20 has a powerhead area 26 comprised of a lower tray portion 28 and a main cowling portion 30. The motor 20 includes a lower unit 34 extending downwardly from the cowling portion 30. The lower unit 34 comprises an upper or "drive shaft housing" section 38 and a lower section 40.

The powerhead area 26 of the motor 20 is connected to a steering shaft (not shown). The steering shaft is supported for steering movement about a vertically extending axis within a swivel or steering bracket 44. The swivel bracket 44 is connected by means of a pivot pin 46 to a clamping bracket 48 which is attached to a transom portion 32 of a hull 36 of the watercraft 24. The pivot pin 46 permits the outboard motor 20 to be trimmed and tilted up about the horizontally disposed axis formed by the pivot pin 46.

Figure 2:
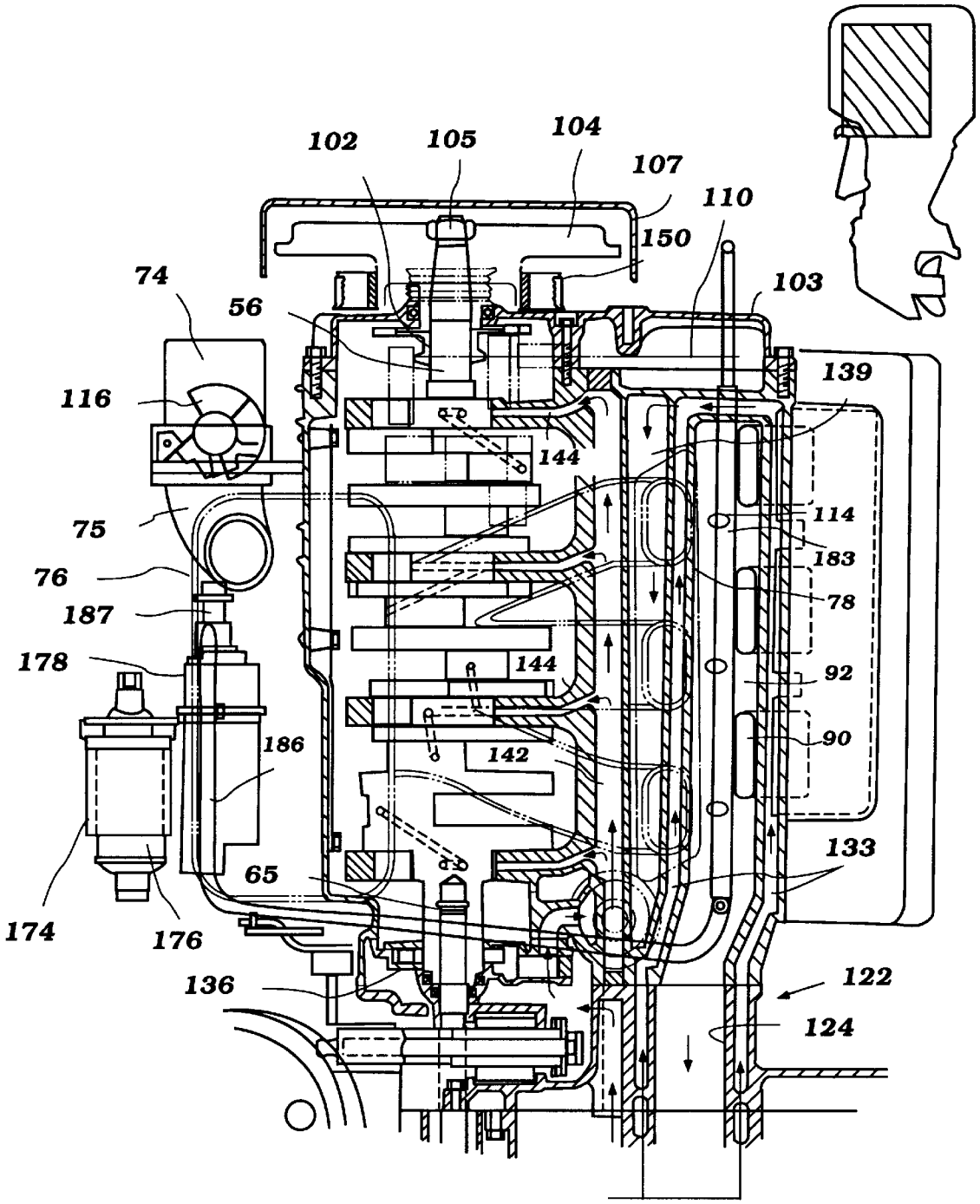
FIG. 2 is a cross-sectional side view of a portion of the engine of the motor illustrated in FIG. 1.
Figure 5:
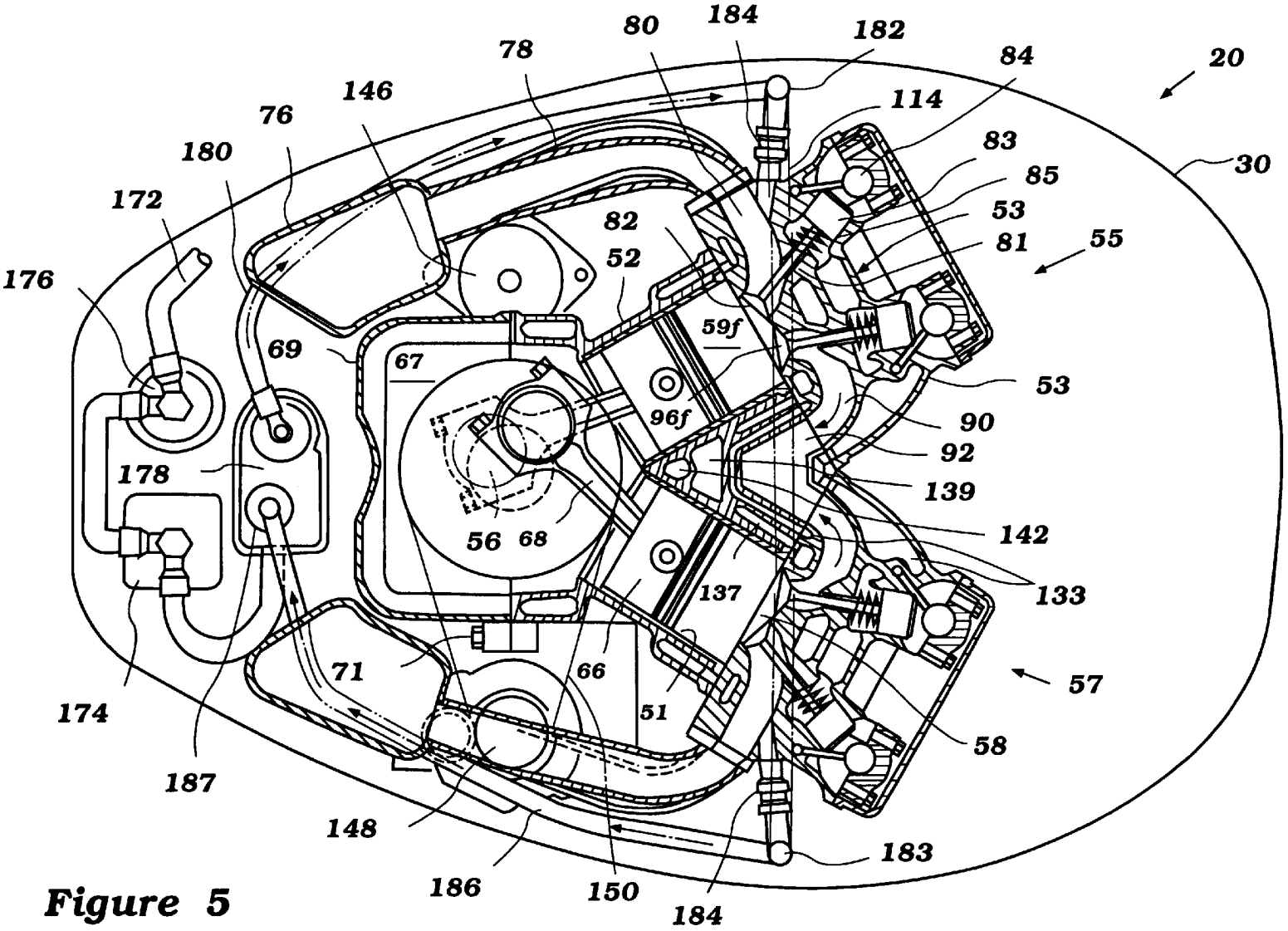
FIG. 5 is a cross-sectional top view of the motor illustrated in FIG. 1, taken along a plane passing through the engine therein.

Referring to FIGS. 1, 2 and 5, the power head 26 of the outboard motor 20 includes the engine 22 which is positioned within the cowling portion 30. The engine 22 is preferably of the six-cylinder, four-cycle variety, and is arranged in a "V" fashion. In this arrangement, the engine 22 has a cylinder block 52 with a first cylinder head 53 and a second cylinder head 54 connected thereto and cooperating therewith to define first and second cylinder banks 55,57 defining a valley therebetween. This valley faces away from the watercraft to which the motor 20 is attached. Each bank preferably defines three cylinders 59, each having a combustion chamber 58. As may be appreciated by those skilled in the art, the engine 22 may have a greater or lesser number of cylinders, such as two, four, or eight or more.

As illustrated in FIG. 5, a piston 66 is movably positioned in each cylinder 59, each cylinder lined with a cylinder sleeve 51. Each piston 66 is connected to a connecting rod 68 extending to a vertically extending (i.e. along a vertical axis "V" as illustrated in FIG. 1) crankshaft 56. Referring to FIG. 2, the crankshaft 56 is connected to a top end 65 of a drive shaft 60 which extends downwardly through the lower unit 34, where it drives a bevel gear and a conventional forward-neutral-reverse transmission 61. A control (not shown) is preferably provided for allowing an operator to remotely control the transmission from the watercraft 24.

The transmission drives a propeller shaft 63 which is journalled within the lower section 40 of the lower unit 34 in a known manner. A hub 62 of a propeller 64 is coupled to the propeller shaft 63 for providing a propulsive force to the watercraft 24 in a manner well known in this art.

The crankshaft 56 is journalled for rotation with respect to the cylinder block 52. A crankcase cover 69 engages an end of the block 52 generically opposite the heads 53,54, defining therewith a crankcase chamber 67 within which the crankshaft rotates. The crankcase cover 69 may be attached to the cylinder block 52 by bolts 71 or similar means for attaching known to those skilled in the art. The crankcase chamber 67 is positioned generally opposite the heads 53,54 and on the side of the engine closest to the watercraft 24.

The engine 22 includes an air intake system 72 for providing air to each combustion chamber 58. The intake system 72 is preferably positioned at the crankcase or watercraft end of the engine 22. As illustrated in FIGS. 1 and 2, air passes through the vent (not shown) in the motor cowling 30 and through an air plenum to a main intake pipe 74. As best illustrated in FIG. 2, a throttle 116 is provided for controlling the flow of air into the combustion chambers 58. Preferably, the throttle 116 comprises a moveable plate positioned within air intake pipe 74, such that the intake pipe 74 may be generally referred to as a throttle body. The throttle 116 is preferably controlled through a cable by the operator of the watercraft.

Branch pipes or passages 75 lead from the main intake pipe or throttle body 74 to first and second surge tanks 76 having branches 78 extending therefrom. The branch pipes 75 may be formed separately or integrally with the throttle body 74. Preferably, each surge tank 76 has three branches 78 extending therefrom, one for each cylinder 59 in a bank. Each branch 78 extends to a passage 80 in the cylinder head 53,54 to one of the combustion chambers 58.

Referring still to FIG. 5, means are provided for controlling the flow of air into each combustion chamber 58. Preferably, this means comprises at least one intake valve 82 corresponding to each intake passage 80. As illustrated, all of the intake valves 82 for each bank of cylinders are preferably actuated by a single intake camshaft 84. The intake camshaft 84 is mounted for rotation with respect to its respective cylinder head 53,54 and connected thereto with at least one bracket . Each intake camshafts 84 rotates within an enclosure defined by the cylinder head 54,55 and a camshaft cover 88 connected thereto.

In particular, each valve 82 has a head which is adapted for seating against a valve seal 79 in the passage 80, and a stem extending from the head through a valve guide 81 to a follower 83. A spring 85 is positioned between the follower 83 and a portion of the cylinder head 53,54 for biasing the valve 82 upwardly into a closed position.

An exhaust system is provided for routing the products of combustion within the combustion chambers 58 to a point external to the engine 22. In particular, an exhaust passage 90 leads from each combustion chamber to a passage 92. The remainder of the exhaust system is described in more detail below.

Referring still to FIG. 5, means are also provided for controlling the flow of exhaust from each combustion chamber 58 to its respective exhaust passage 90. Preferably, this means comprises at least one exhaust valve 96. Like the intake valves 82, the exhaust valves 96 of each cylinder bank are preferably all actuated by a single exhaust camshaft 98. Each exhaust camshaft 98 is journalled for rotation with respect to its respective cylinder head 54,55 and connected thereto with at least one bracket. Each exhaust camshaft 98 is enclosed within the camshaft cover 88.

As with the intake valve 82, each exhaust valve 96 preferably includes a head for selective positioning against a valve seat 95 in the passage 90. A stem extends from the head of the valve 96 through a valve guide 97 in the cylinder head 53,54. A follower 99 is positioned at the opposite end of the stem for engagement by the camshaft 98. A spring 101 is positioned between the follower 99 and the cylinder head 53,54 for biasing the valve 96 into its closed position.

As best illustrated in FIGS. 1 and 2, means are provided for driving the camshafts 84,98. Preferably, a toothed gear 102 is mounted near a top end of the crankshaft 56 positioned within a chamber formed by the cylinder block 52 and a timing chain cover 103, and just below a flywheel 104 also positioned on the crankshaft 56. An exhaust camshaft gear (not shown) is positioned on each exhaust camshaft 98, and an intake camshaft gear (not shown) is positioned on each intake camshaft 84. A timing chain 110 extends around the timing belt pulley 102 and the exhaust and intake camshaft gears corresponding to the cylinder banks. By this arrangement, the camshaft 56 indirectly drives the camshafts 84,98. One or more idler gears (not shown) may be provided for routing the chain.

The flywheel 104 is preferably maintained in position on the top end of the crankshaft 56 with a nut 105. The flywheel 104 is preferably positioned under a flywheel cover 107.

As best illustrated in FIG. 1, an exhaust guide 122 is positioned at the bottom end of the engine 22. The exhaust guide 122 has a passage 124 extending therethrough which communicates with the exhaust passages 92 in a manner described in more detail below. An exhaust pipe 126 is connected to the bottom side of the exhaust guide 122 in alignment with the passage 124. The exhaust pipe 126 terminates within a chamber of a muffler 128.

Figure 3:
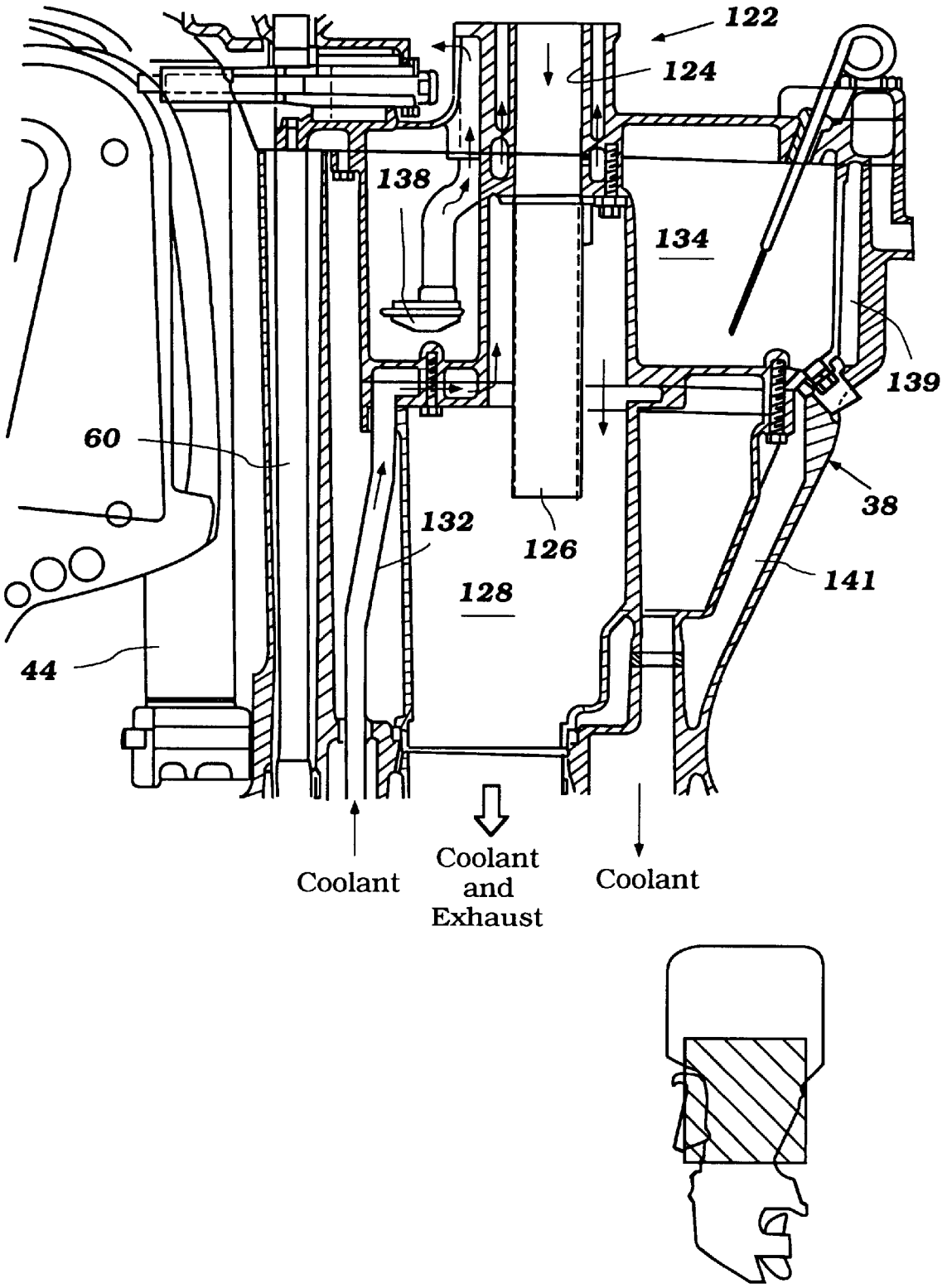
FIG. 3 is an enlarged cross-sectional side view of a middle portion of the motor illustrated in FIG. 1.
Figure 4:
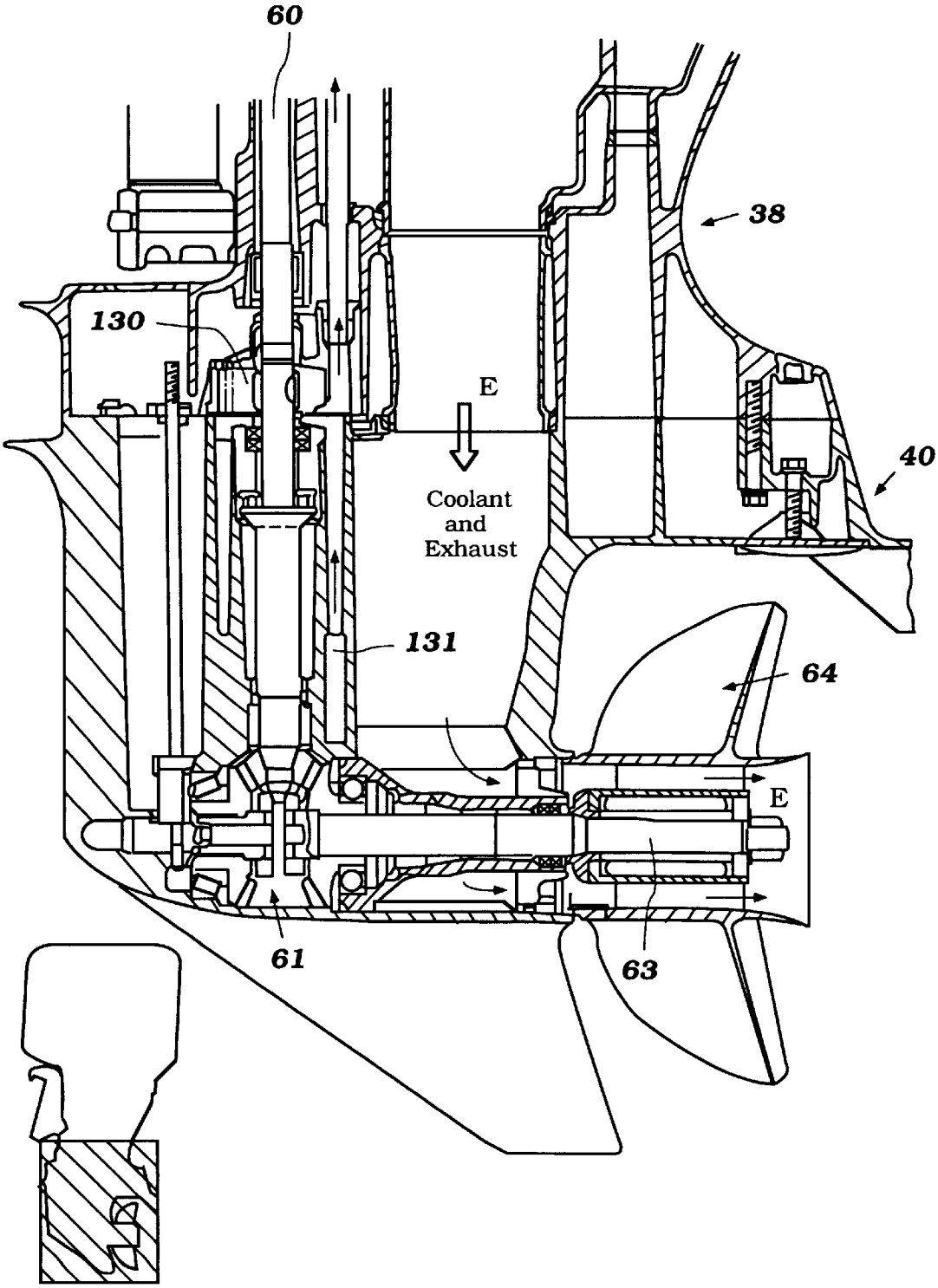
FIG. 4 is an enlarged cross-sectional side view of a lower portion of the motor illustrated in FIG. 1.

Referring also to FIG. 3, the muffler 128 is positioned within the lower unit 34 and between the drive shaft 60 and a cooling liquid return. An exhaust gas outlet is provided in the bottom end of the muffler 128, through which the exhaust gas is routed (in the direction of arrows "E") through the hub 62 of the propeller 64 to a point external of the motor 20, as best illustrated in FIG. 4.

A fuel delivery system is provided for delivering fuel to each combustion chamber 58 for combustion therein. Referring to FIG. 3, fuel is pumped from a fuel source, such as a tank on board the watercraft 24, through a supply line 172 by a low pressure pump 174. This pump 174 may be of the diaphragm type. Preferably, the pumped fuel is passed through a filter 176 positioned along the line 172.

The fuel is delivered by the pump 174 to a vapor separator 178. After separation of air from the fuel, a high pressure pump (not shown, but preferably positioned within the separator 178) delivers fuel under high pressure to a high pressure fuel line 180. This line 180 leads to a fuel rail 182 corresponding to the first cylinder bank 55. A line 185 extends from the opposite end of this fuel rail 182 to a first end of a fuel rail 183 corresponding to the other cylinder bank 57. Fuel passes from each rail 182 through a passage 184 extending therefrom to each fuel injector 114.

Fuel which is supplied to the fuel rails 182,183 but not delivered by the injectors 114 is returned to the vapor separator 178 through a return line 186 extending from the fuel rail 183. A pressure regulator 187 is positioned along the return line 186 near the vapor separator 178. The pressure regulator 187 is arranged to maintain the fuel pressure within the fuel rails 182,183 at a high pressure, but yet allow the un-delivered fuel to return to the separator, as is well known in the art.

As illustrated in FIGS. 1, 2, 5 and 7–8, the fuel filter 172, low pressure pump 174 and vapor separator 178 are all positioned within the cowling 30 and at the front end of the engine 22 generally opposite its valley.

A suitable ignition system is provided for igniting an air and fuel mixture within each combustion chamber 58. Such systems are well known to those skilled in the art, and as the ignition system forms no part of the present invention, such is not described in detail herein. The ignition system may include a spark plug for use in igniting the air and fuel mixture within each combustion chamber 58.

A cooling system is provided for cooling the engine 22. Referring to FIG. 1, cooling liquid, preferably water from the body of water in which the motor 22 is positioned, is pumped by a water pump 130 positioned in the lower unit 34 through a water inlet 131. The pump 130 is preferably driven by the drive shaft 60, and expels the cooling liquid upwardly through a cooling liquid pipe 132. The coolant flows through the supply pipe 132 from the pump 130 to the coolant jacket 133 for cooling the areas of the engine 22 surrounding the exhaust passage 92. Preferably, a pressure valve 188 is positioned along the coolant path after cooling the exhaust passage 92. This pressure valve 188 is utilized to divert coolant through a relief passage 189 and thereon to the coolant drain system in the even the coolant pressure exceeds a predetermined high pressure.

A thermostat 190 is preferably positioned along the coolant path for monitoring the temperature of the coolant. A control valve 192 is also positioned along the coolant path preferably before the coolant passes through the cylinder block and heads 52,53,54 of the engine 22 The thermostat 192 is preferably positioned along the coolant path downstream of the passages 135,137 through the cylinder block and heads 52,53,54. The control valve 192 is controlled by the thermostat 190, such that if the coolant temperature is high, the valve 192 is opened to allow coolant to flow though the engine 22 at a high rate. On the other hand, if the temperature of the coolant is low, then the valve 192 is closed, allowing the engine to warm up. This cooling liquid passes into a cooling jacket 133 surrounding the exhaust passages 92 and then is guided into a number of cooling liquid passages 135 throughout the cylinder heads 53,54 and then to coolantjackets 137 around the cylinders 59 in the cylinder block 52.

The cooling liquid is preferably routed to a generally vertically extending return passage 139 through the cylinder block 52 (illustrated schematically in FIG. 1), for draining the cooling liquid to the bottom of the engine 22. The coolant is then split. A first amount of coolant is directed to a coolant pool 139 surrounding an oil reservoir or pan 134, and another pool 141 near the muffler 128. When the liquid level in the pool 141 becomes to high, the cooling liquid runs over an overflow ledge or weir to a passage leading to a drain. The cooling liquid diverted to the drain is discharged from the motor.

The remaining amount of coolant is directed around the exhaust pipe 126 for cooling it. This coolant then flows into the muffler 128, where it is mixed with the exhaust gas. The coolant is carried with the exhaust gas through the propeller hub 62 discharge back to the body of water.

Preferably, the engine 22 includes a lubricating system for providing lubricant to the various portions of the engine in accordance with the present invention. As illustrated in FIGS. 2 and 3, the lubricating system includes the oil reservoir 134 positioned below the engine 22. The reservoir 134 is in communication with an oil pump 136 via a suction tube 138. The oil pump is drivingly positioned on the end of the crankshaft 56 at the bottom of the engine 22. Seals are provided for sealing the oil pump with respect to the remainder of the engine 22. The oil pump draws lubricant from the reservoir 134 and then delivers it through a connecting passage to a main gallery 142. Branch passages 144 extend from the main gallery 142 for providing lubricant to crankshaft bearings and the like.

As illustrated in FIG. 5, the engine 22 may include additional engine auxiliary features such as a starter motor 146 and an alternator 148. Preferably, the starter motor 146 is positioned for engagement with the flywheel 104 for use in starting the engine 22, as is well known to those skilled in the art.

The alternator 148 is preferably utilized to produce electricity for firing the spark plugs and similar functions. The alternator 148 is run by a belt 150 which is driven by a pulley mounted on the end of the crankshaft 56 just below the flywheel 104, as best illustrated in FIG. 2.

The motor 20 includes an exhaust system. As disclosed above, exhaust is routed through a passage 90 from each cylinder 59 in a cylinder head 53,54 to a main exhaust passage 92.

Figure 6:
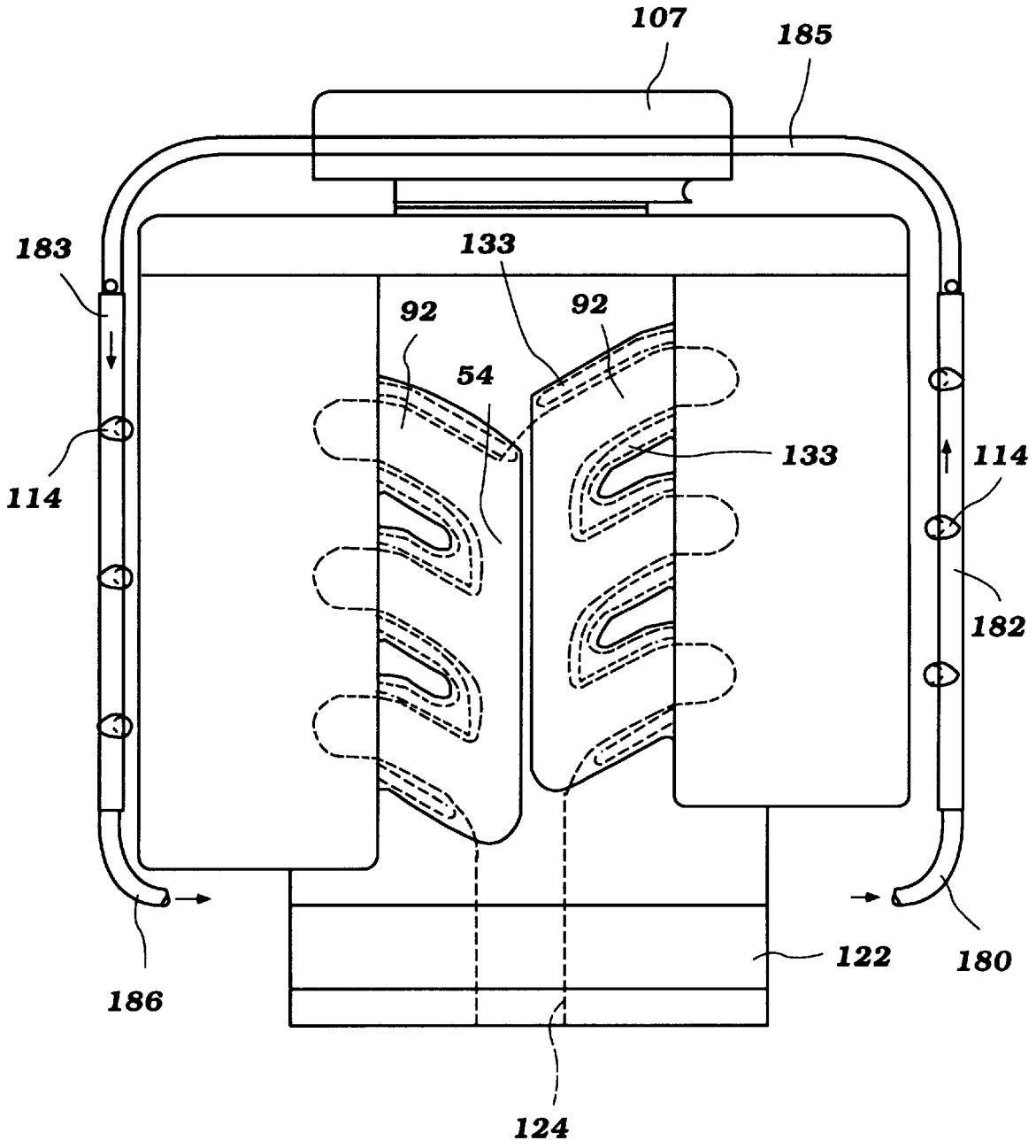
FIG. 6 is a rear view of the engine of the motor illustrated in FIG. 1, illustrating an exhaust arrangement thereof.
Figure 7:
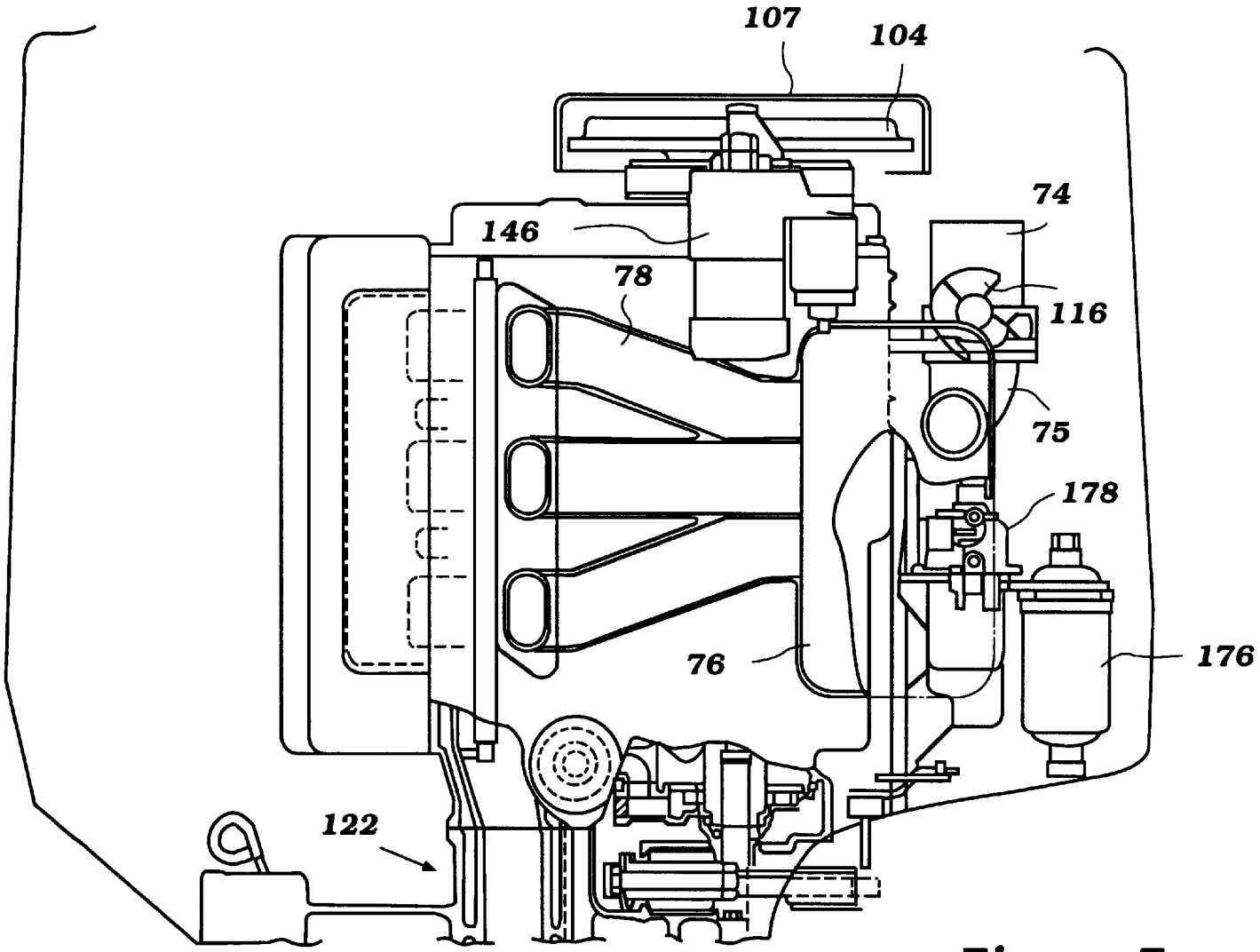
FIG. 7 is a cross-sectional side view of the motor illustrated in FIG. 1, exposing the engine therein and illustrating the first embodiment intake system.
Figure 8:
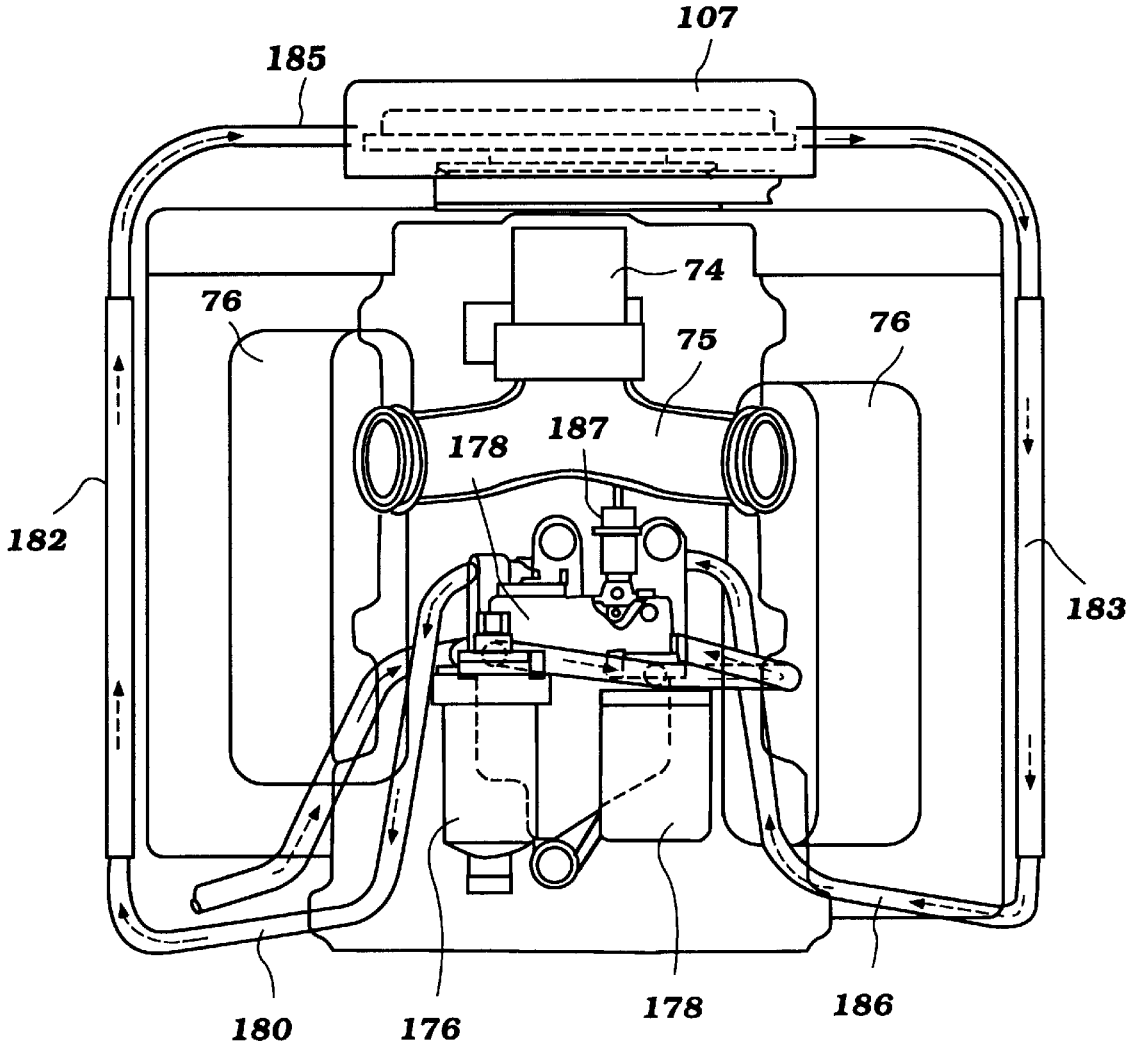
FIG. 8 is an front view of the motor illustrated in FIG. 1, illustrating the first embodiment intake system.

As best illustrated in FIG. 6, each exhaust passage 90 extending through the cylinder head 53,54 from each combustion chamber 58 curves generally inward towards the valley between the cylinder banks 55,57. The heads 53,54 and cylinder block 52 cooperate to define a generally "V" shaped main exhaust passage 92 which extends vertically down through the valley to the bottom of the engine 22. This passage 92 leads to a passage 124 in the exhaust guide 122 and thereafter through the remainder of the exhaust system.

In this arrangement, the main gallery 142 of the lubricating system preferably extends vertically through the portion of the cylinder block 52 positioned between the cylinder banks 55,57 and between the coolant return passage 139.

So arranged, the coolant jacket 133 surrounding the exhaust passage 92 is positioned on each side thereof, part of the jacket 133 formed within the cylinder block 52 and part within each cylinder head 53,54. The cylinder cooling jackets 137 are positioned within the walls of the cylinder block 52 adjacent the jacket 133, but defined separately therefrom.

This particular intake system arrangement permits the engine 22 to have a compact arrangement. First, the surge tanks 76 are mounted at the front end of the engine 22 and spaced from one another. The air intake, including the throttle body 74, extends upwardly between the surge tanks 76 towards the top of the engine 22. One or more engine auxiliary features are positioned in the space between the surge tanks 76 and below the throttle body 74. In the embodiment illustrated, these auxiliary features or parts comprise the vapor separator 178, fuel filter 176 and low pressure fuel pump 176, although it is contemplated that other features may be positioned there in the alternative.

FIGS. 9–16 illustrate an outboard motor 20*a* powered by an engine 22*a* having an intake system 72*a* in accordance with a second embodiment of the present invention. In the description and illustration of this embodiment, like parts have been given like reference numerals to those utilized in describing and illustrating the first embodiment, except that an "a", designator has been added thereto.

Figure 9:
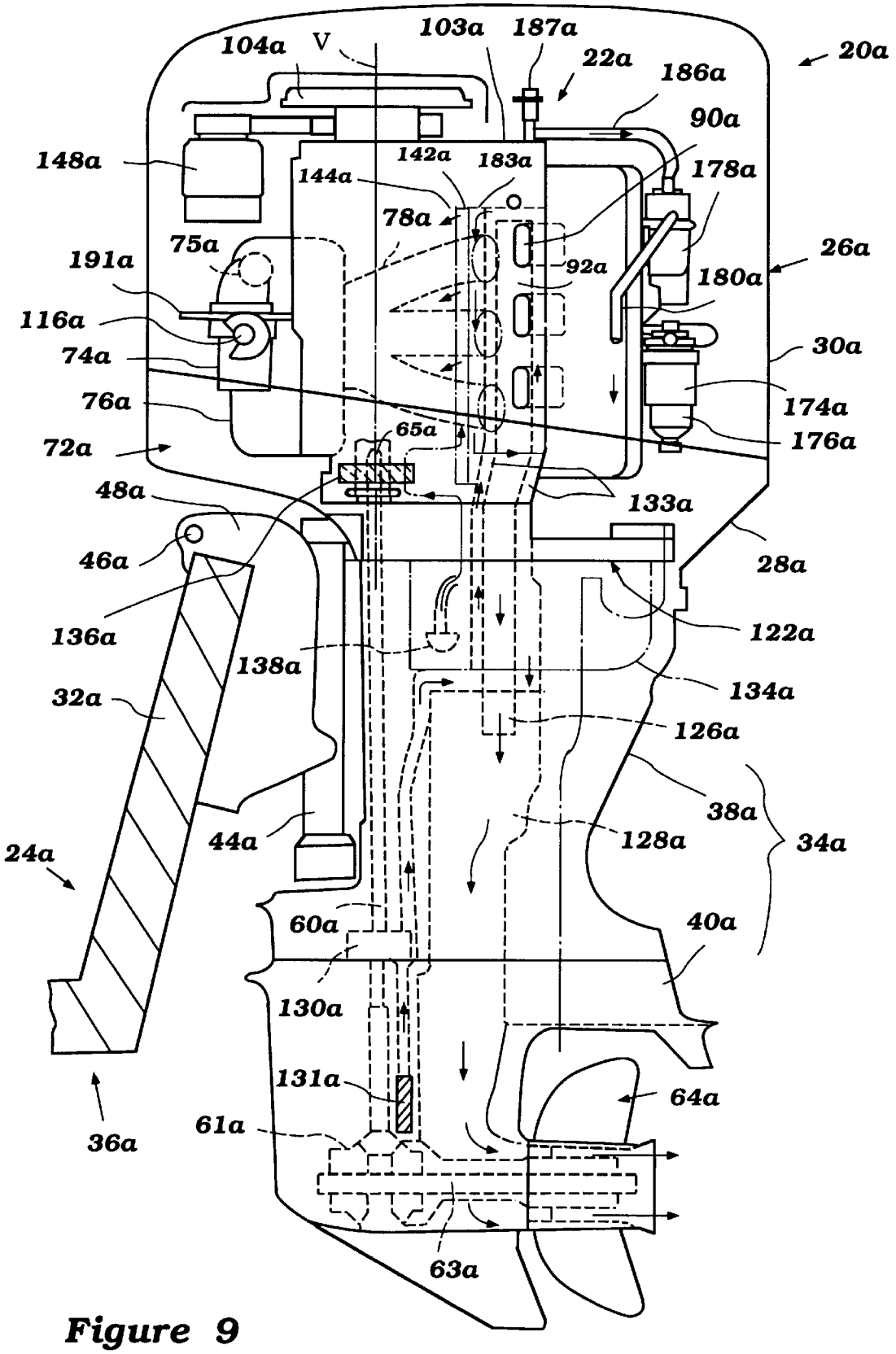
FIG. 9 is a cross-sectional side view of a motor powered by an engine and having an intake system in accordance with a second embodiment of the present invention.
Figure 10:
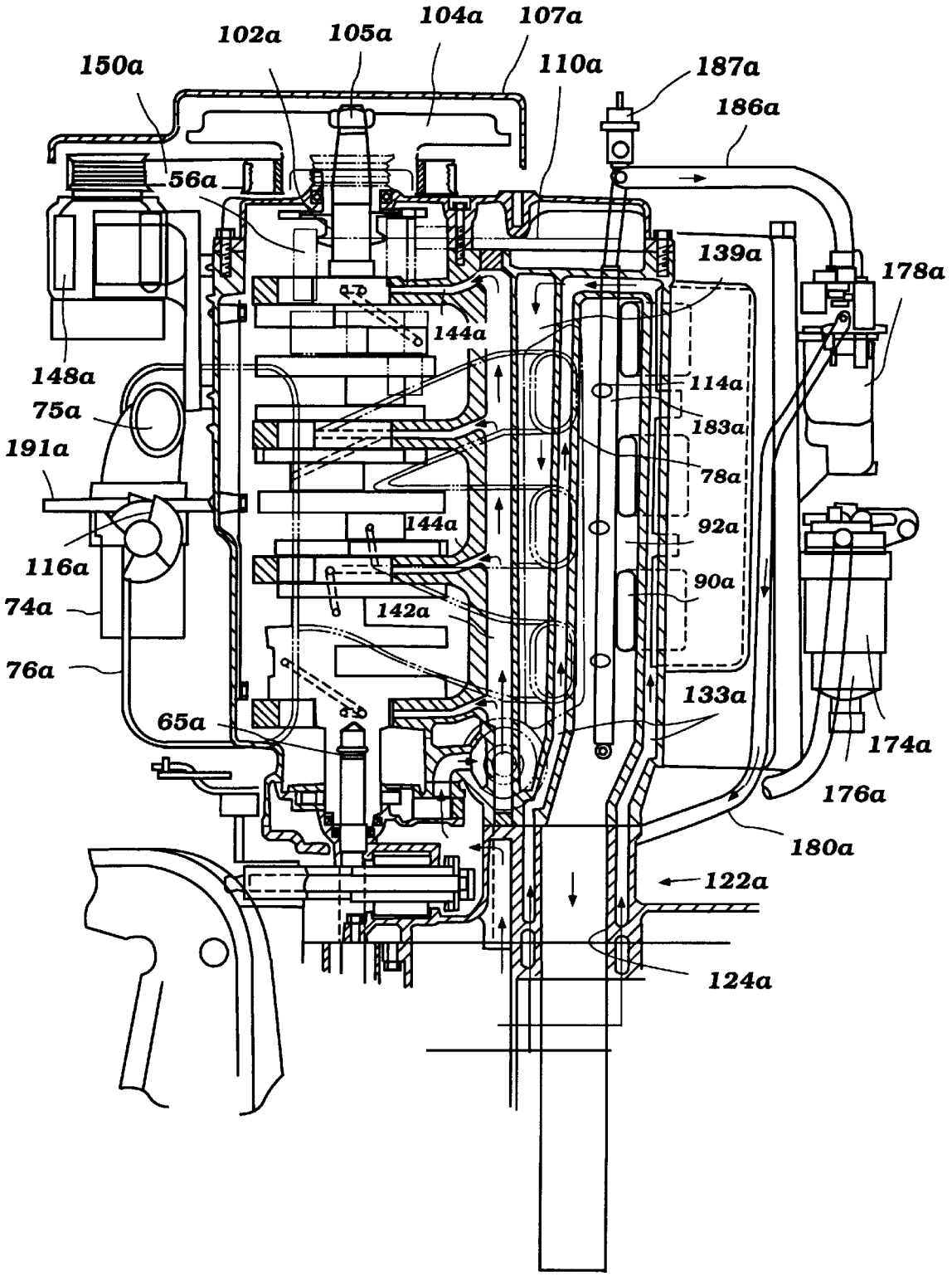
FIG. 10 is a cross-sectional side view of the engine of the motor illustrated in FIG. 9.
Figure 11:
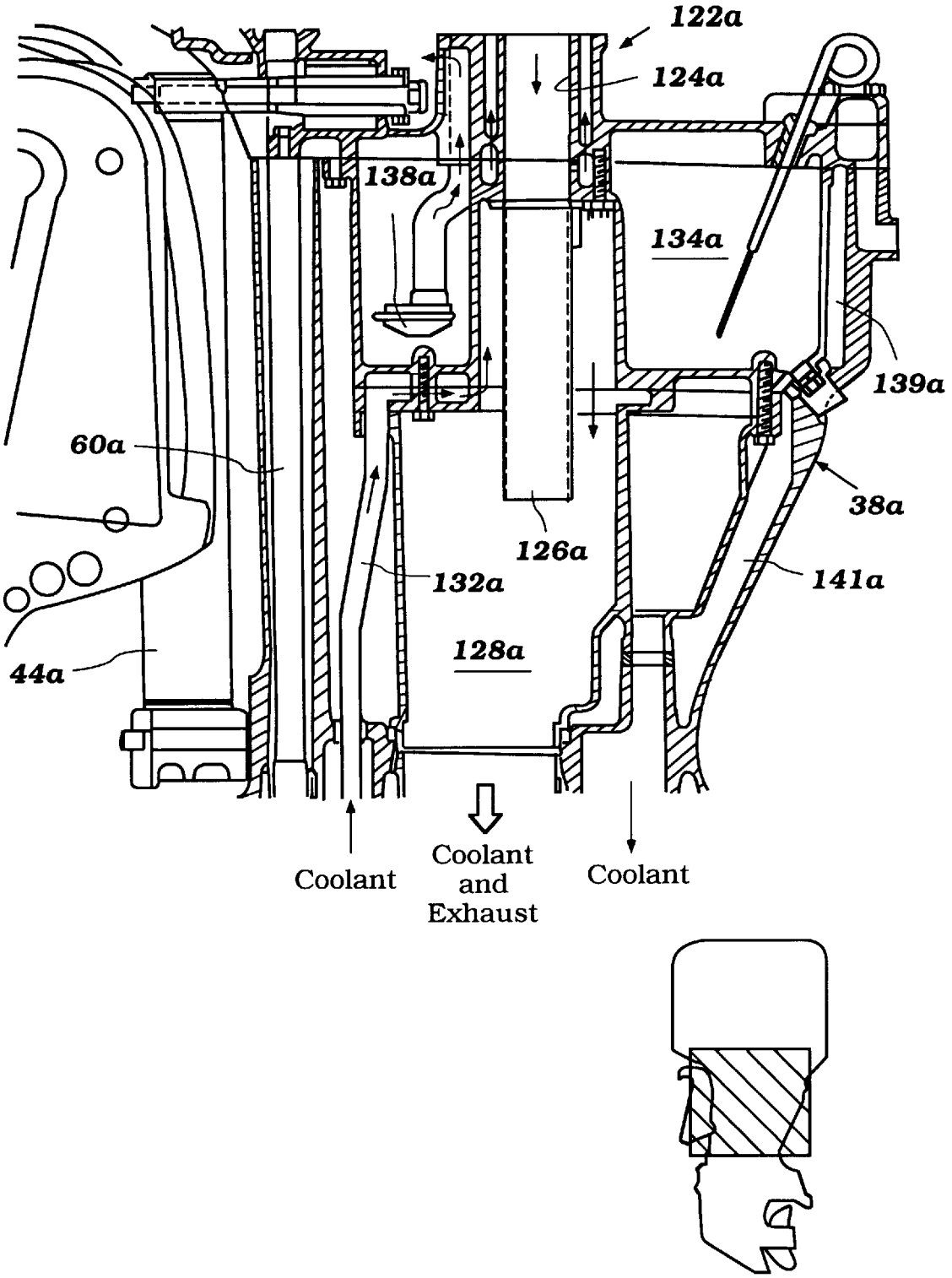
FIG. 11 is an enlarged cross-sectional side view of a middle portion of the motor illustrated in FIG. 9.
Figure 12:
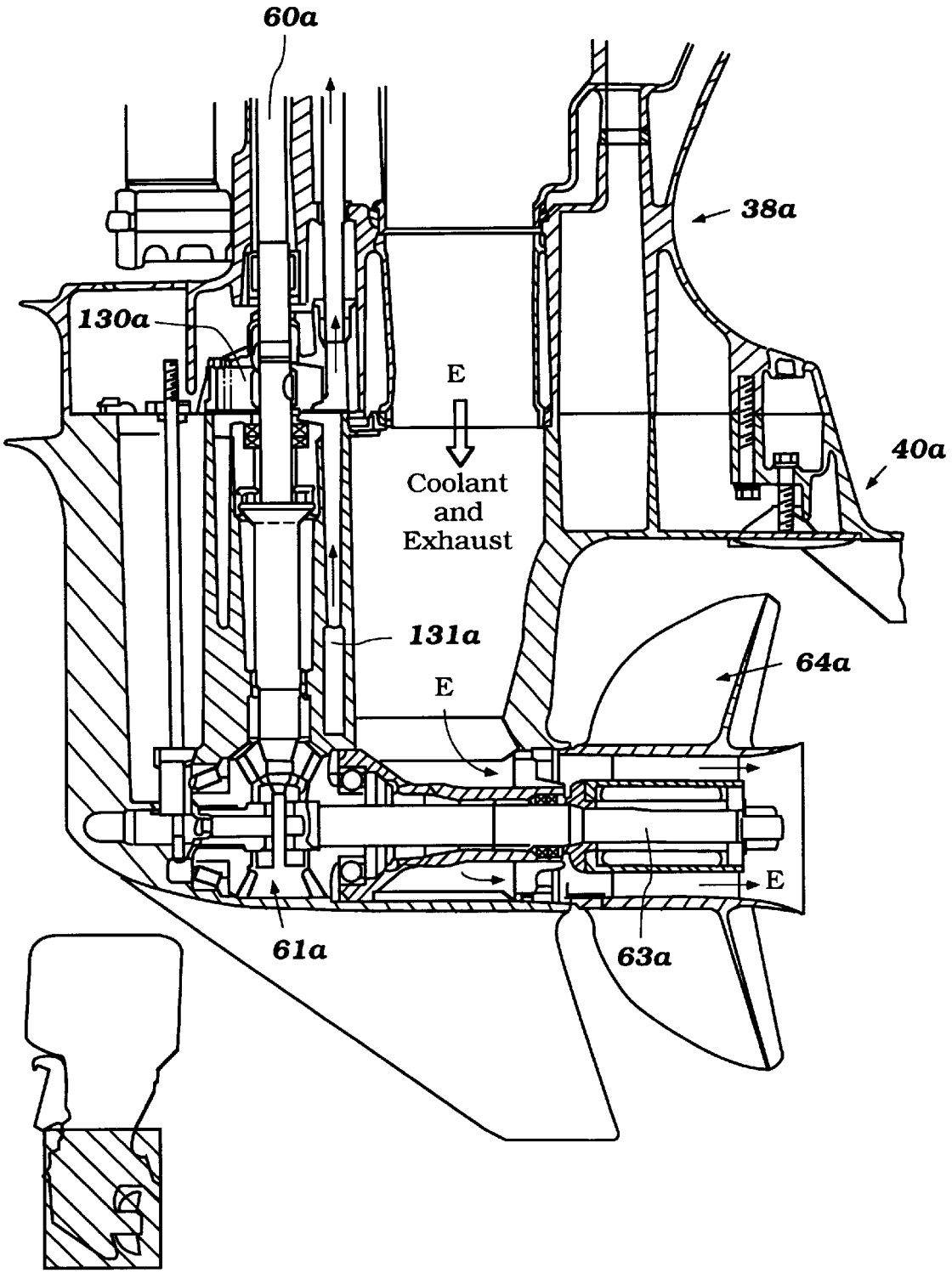
FIG. 12 is an enlarged cross-sectional side view of a lower portion of the motor illustrated in FIG. 9.
Figure 13:
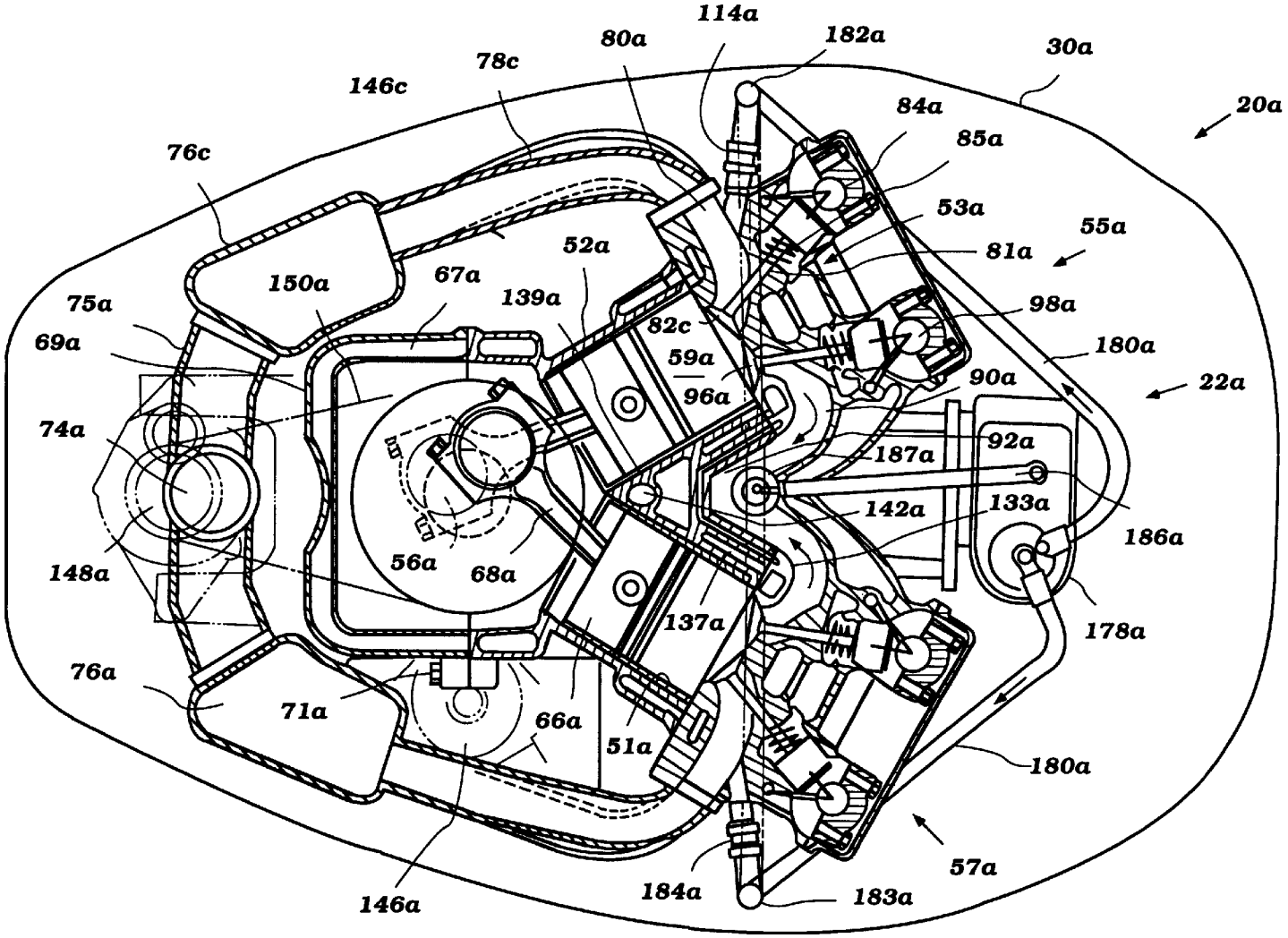
FIG. 13 is a cross-sectional top view of the motor illustrated in FIG. 9, taken along a plane passing through the engine therein.
Figure 14:
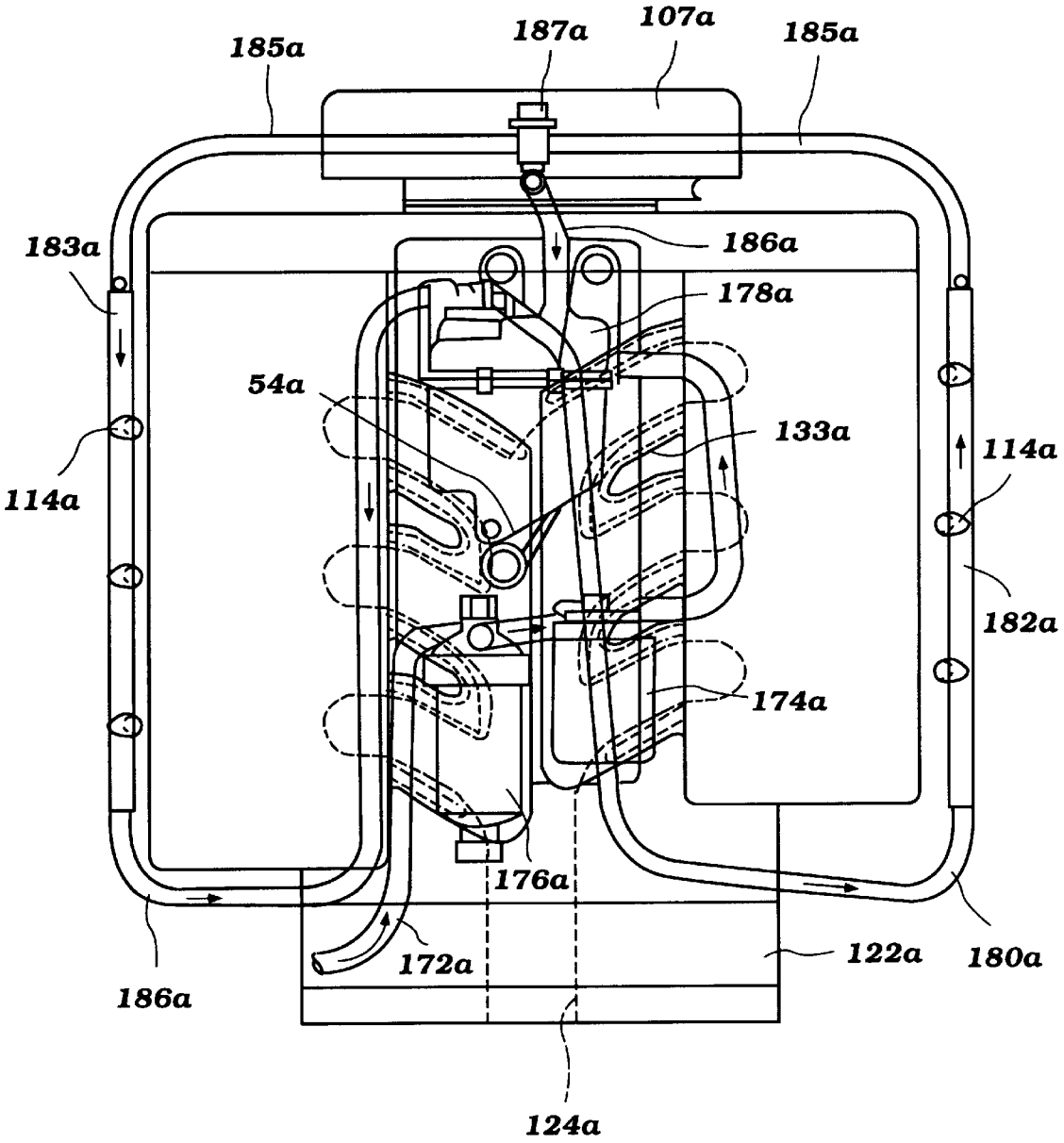
FIG. 14 is a rear view of the engine of the motor illustrated in FIG. 9, illustrating an exhaust arrangement thereof.
Figure 15:
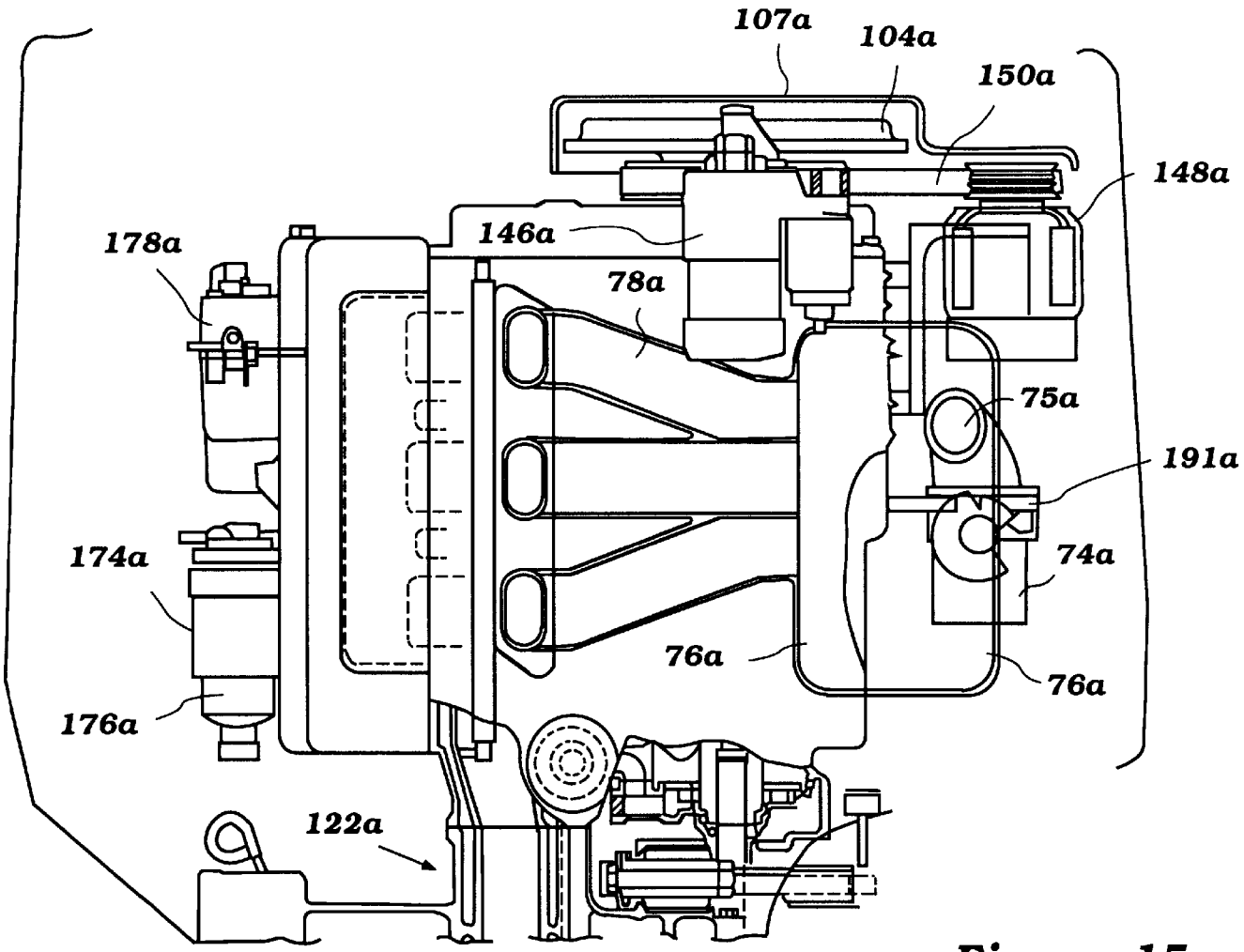
FIG. 15 is a cross-sectional side view of the motor illustrated in FIG. 9, exposing the engine therein and illustrating the second embodiment intake system.
Figure 16:
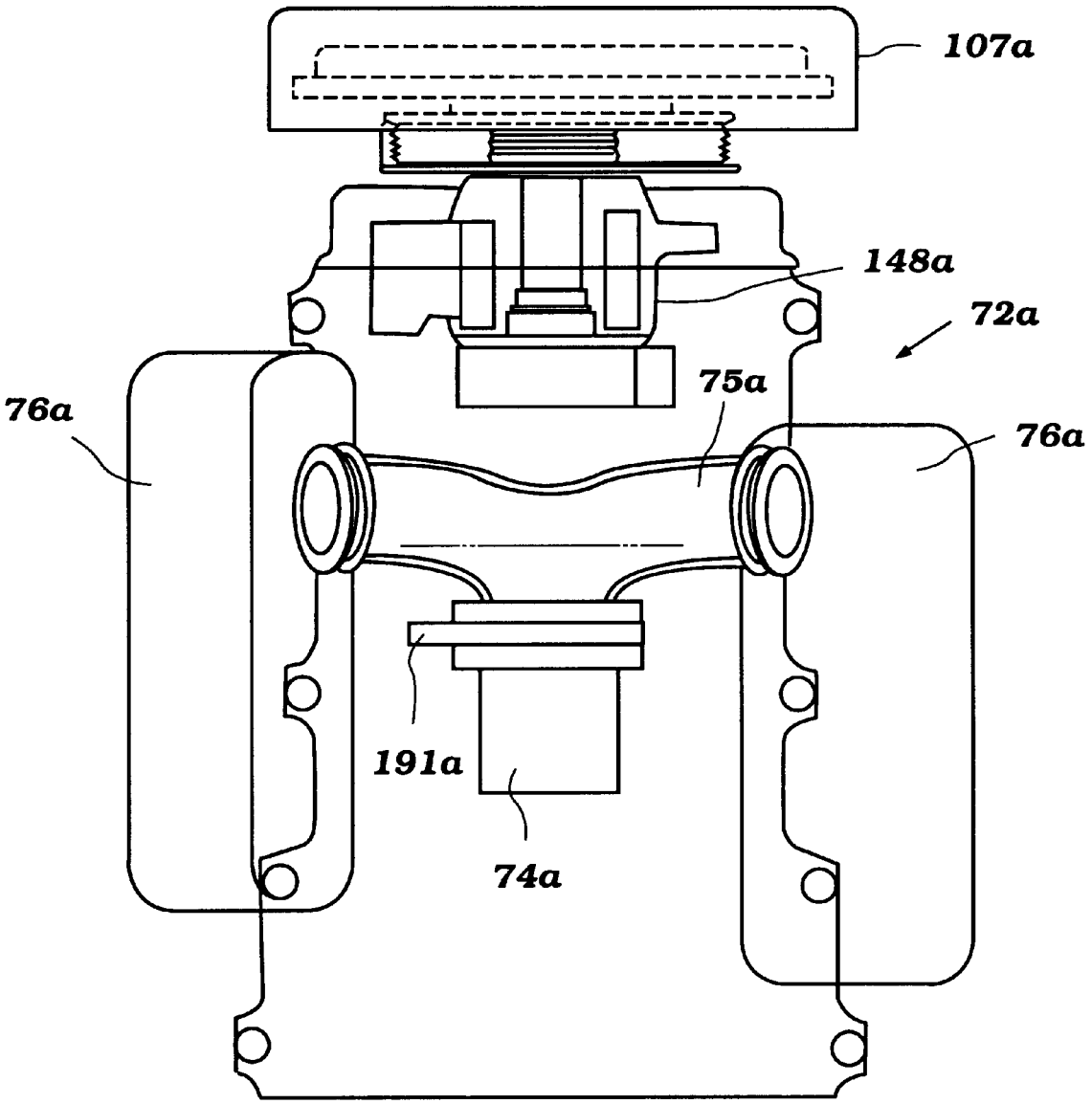
FIG. 16 is an front view of the motor illustrated in FIG. 9, illustrating the intake system in accordance with the second embodiment of the present invention.

In this embodiment, the vapor separator 178*a*, low pressure fuel pump 174*a* and fuel filter 172*a* are all positioned in the valley of the engine 22*a*. As illustrated in FIGS. 9 and 10, the vapor separator 178*a* is positioned above the low pressure fuel pump 174*a* and fuel filter 172, which are themselves generally positioned side-by-side.

In this arrangement, fuel is drawn from a fuel supply through a supply line 172*a* by the low pressure pump 174*a* through the adjacent filter 176*a*. The fuel is delivered up to the vapor separator 178*a*. Then, with the aid of a high pressure pump (not shown), fuel is delivered through a pair of high pressure supply lines 180*a* to the pair of fuel rails 182*a*,183*a*, one each of the fuel rails corresponding to one of the cylinder banks 55*a*,57*a*. Fuel supplied to the fuel rails 182*a*,183*a* but not delivered by the fuel injectors is routed back to the vapor separator 178*a* through a return line 185*a*.

The return line 185*a* from each fuel rail 182*a*,183*a* extends to a pressure regulator 187*a* positioned at the top end of the engine 22*a*. A single return line 186*a* extends from the pressure regulator 186*a* downwardly to the vapor separator 178*a*.

As illustrated in FIG. 1, in this embodiment the alternator 148*a* is positioned near the top of the engine 22*a* on the crankcase end of the engine 22*a* opposite its valley (i.e. at the front end of the engine 22*a*). Again, the alternator 148*a* is preferably powered by a belt 150*a* driven by a pulley positioned on the crankshaft 65*a* of the engine 22*a*.

Because of the position of the alternator 148*a*, the air inlet is formed in a lower end of the throttle body 74*a*. Air passes upwardly through the throttle body 74*a*, into the pipes 75*a* to the surge tanks 76*a*.

Preferably, the throttle 116*a* and the branch pipes 75*a* are separated by an insulating mounting plate 191*a*. The plate 191*a* is preferably connected to the crankcase 67*a* cover and extends outwardly therefrom for supporting the throttle body 74*a*. The plate 191*a* is preferably constructed of a thermal insulating material, whereby little heat is transferred from the heated crankcase cover 67*a* to the throttle body 74*a* and incoming air. Also, the plate 191*a* serves to shield somewhat the throttle body 74*a* from the heat generated by the engine auxiliary component(s) or part(s) mounted thereabove, which in the embodiment illustrated comprises the alternator 148*a*.

This particular intake arrangement has generally the same advantages as those of the first embodiment. Further, because the air intake into the throttle body 74*a* faces downward, the risk of water entering the intake system and fouling it is reduced.

In both embodiments, the placement of the intake system 72,72*a* at the front end of the engine 22,22*a* along with one or more engine auxiliary features has the benefit of moving the center of gravity of the engine forward towards the watercraft 24,24*a*.

Of course, the foregoing description is that of preferred embodiments of the invention, and various changes and modifications may be made without departing from the spirit and scope of the invention, as defined by the appended claims.

What is claimed is:

1. An engine of the type for positioning in a cowling of an outboard motor for powering said motor, said engine having a cylinder block having a first cylinder head connected thereto and cooperating therewith to define a first cylinder bank containing at least one cylinder and a second cylinder head connected thereto and cooperating therewith to define a second cylinder bank containing at least one cylinder, said first and second cylinder banks arranged generally in a "V" shape and defining a valley therebetween, said engine including an air intake system for providing air to said cylinders, comprising a first surge tank associated with said first cylinder bank and a second surge tank associated with said second cylinder bank, said surge tanks provided at an end of said cylinder block generally opposite said cylinder heads, an intake passage leading from each surge tank to the cylinder of its respective cylinder bank, a throttle body positioned generally between said surge tanks and having a passage leading therefrom to each surge tank, said throttle body defining an air passage extending downwardly from said passages to an air inlet opening, at least one engine auxiliary part positioned above said throttle body, an insulating mounting part extending from said engine and connected to said throttle body, and an exhaust passage for routing exhaust from each cylinder, said exhaust passage extending through said valley of said engine.

2. The engine in accordance with claim 1, wherein said engine auxiliary part comprises an alternator.

3. The engine in accordance with claim 1, wherein a crankcase cover is connected to said cylinder block opposite said heads, and wherein said insulating part is connected to said crankcase cover.

4. The engine in accordance with claim 1, wherein the passage leading from the throttle body to each surge tank comprises a "Y"-shaped intake having a first portion connected to said throttle body and branch portions extending generally perpendicular thereto to said surge tanks.

5. The engine in accordance with claim 1, wherein said intake passages for each bank are of substantially equal length.

6. The engine in accordance with claim 1, wherein said engine has a vertically extending crankshaft.

7. An engine for positioning in a cowling of an outboard motor for use in powering a water propulsion device of the motor, the engine having a cylinder block having a first cylinder head connected thereto and cooperating therewith to define a first cylinder bank containing at least one cylinder and a second cylinder head connected thereto and cooperating therewith to define a second cylinder bank containing at least one cylinder, said first and second cylinder banks arranged generally in a "V" shape and having a valley, therebetween at a first end of said engine, said engine having a generally vertically extending crankshaft and having a second-end generally opposite said first end, an air intake system for providing air to said cylinders positioned at said second end of said engine, said intake system comprising a pair of surge tanks each associated with a respective one of said cylinder banks and a passage leading toward said first end of said engine from each surge tank to each cylinder of its respective cylinder bank, a throttle body positioned between said surge tanks at said second end of said engine, said throttle body having a first portion with an air inlet and a second portion leading to each of said surge tanks, and at least one engine auxiliary part positioned in vertically spaced relation to said throttle body at said second end of said engine.

8. The engine in accordance with claim 7, wherein the throttle body second portion comprise a branch passage extending inwardly from each surge tank, said branch passages joining generally midway between said surge tanks, said throttle body extending downwardly from said branch passages to said air inlet and said engine auxiliary part is positioned above said throttle body.

9. The engine in accordance with claim 8, wherein said engine auxiliary part comprises an alternator.

10. The engine in accordance with claim 7, wherein said throttle body extends upwardly to said air inlet.

11. The engine in accordance with claim 10, wherein said engine auxiliary comprises at least one component of a fuel system of said engine positioned below said throttle body.

12. The engine in accordance with claim 11, wherein said at least one component of said fuel system comprises a vapor separator positioned between said surge tanks.

13. The engine in accordance with claim 7, wherein a crankcase cover is connected to said body opposite said heads, and a thermal insulating mount extends from said crankcase cover to said throttle body for supporting said throttle body.

14. The engine in accordance with claim 7, wherein at least one exhaust passage extends through said valley of said engine, said exhaust passage communicating with said cylinders for routing exhaust gas therefrom.

15. An engine for use in powering a water propulsion device of an outboard motor, the engine having a cylinder block having a first cylinder head connected thereto and cooperating therewith to define a first cylinder bank containing at least one cylinder and a second cylinder head connected thereto and cooperating therewith to define a second cylinder bank containing at least one cylinder, said first and second cylinder banks arranged generally in a "V" shape and having a valley therebetween at a first end of said engine, said engine having a crankcase cover connected to said block opposite said cylinder heads and defining a crankcase, an air intake system for providing air to said cylinder positioned at said crankcase end of said engine, said intake system comprising a pair of surge tanks each associated with a respective cylinder bank and a passage leading from each surge tank to each cylinder of its respective cylinder bank, a throttle body positioned between said surge tanks, said throttle body having a first end with an air inlet and a second end leading to each of said surge, tanks, said throttle body connected to an insulating mounting plate extending from said crankcase cover of said engine.

16. The engine in accordance with claim 15, further including an engine auxiliary component positioned above said throttle body.

17. The engine in accordance with claim 15, wherein said throttle body extends downwardly to said air inlet.

18. The engine in accordance with claim 15, further including an engine auxiliary component positioned below said throttle body.

19. The engine in accordance with claim 15, wherein said engine includes a crankshaft mounted for rotation with said crankcase and wherein said engine is oriented such that said crankshaft is generally vertically extending.

* * * * *